US009920565B2

(12) United States Patent
Bolden

(10) Patent No.: US 9,920,565 B2
(45) Date of Patent: Mar. 20, 2018

(54) SYSTEMS AND METHODS FOR MARKING INDIVIDUALS WITH AN INDENTIFYING SUSBSTANCE

(71) Applicant: Capital One Financial Corporation, McLean, VA (US)

(72) Inventor: Thomas G. Bolden, Powhatan, VA (US)

(73) Assignee: CAPITAL ONE FINANCIAL CORPORATION, McLean, CA (US)

( * ) Notice: Subject to any disclaimer, the term of this patent is extended or adjusted under 35 U.S.C. 154(b) by 0 days.

(21) Appl. No.: 14/951,185

(22) Filed: Nov. 24, 2015

(65) Prior Publication Data

US 2016/0076297 A1 Mar. 17, 2016

Related U.S. Application Data

(63) Continuation of application No. 14/100,372, filed on Dec. 9, 2013, now Pat. No. 9,228,388.

(60) Provisional application No. 61/735,142, filed on Dec. 10, 2012.

(51) Int. Cl.
*E05G 1/12* (2006.01)
*G08B 15/02* (2006.01)

(52) U.S. Cl.
CPC ..... *E05G 1/12* (2013.01); *G08B 15/02* (2013.01)

(58) Field of Classification Search
CPC ..... B41M 3/144; G07D 7/12; G08B 15/02; E05G 1/12
USPC ..... 109/20, 25, 29, 31–33
See application file for complete search history.

(56) References Cited

U.S. PATENT DOCUMENTS

| | | | |
|---|---|---|---|
| 1,462,781 | A | 7/1923 | Babiarz |
| 1,910,472 | A | 5/1933 | McClun |
| 1,924,746 | A | 8/1933 | Niacham |
| 2,037,399 | A | 4/1936 | Lester |
| 2,663,271 | A | 12/1953 | Otto |
| 2,909,767 | A | 10/1959 | Saltman |
| 3,230,912 | A | 1/1966 | William |
| RE27,618 | E | 4/1973 | Robeson |
| 3,730,110 | A | 4/1973 | Peters |
| 4,104,974 | A | 8/1978 | Robinett |

(Continued)

FOREIGN PATENT DOCUMENTS

GB 2 472 982 3/2011

OTHER PUBLICATIONS

International Search Report and Written Opinion of the International Searching Authority issued in PCT/US13/74077, dated Feb. 14, 2014.

(Continued)

*Primary Examiner* — Suzanne L Barrett
(74) *Attorney, Agent, or Firm* — Hunton & Williams LLP

(57) ABSTRACT

The present application discloses systems and methods for marking an individual with an identifying substance. The system includes a spray delivery device configured to release a pressurized substance in response to an activation signal, an activation device configured to transmit an activation signal to the spray delivery device, and a power supply, configured to provide power to at least one of the activation devices and the spray delivery devices. The method includes storing a pressurized substance, receiving an activation signal at a spray delivery device, and releasing the pressurized substance in response to the received activation signal.

20 Claims, 3 Drawing Sheets

(56) References Cited

U.S. PATENT DOCUMENTS

| | | | | |
|---|---|---|---|---|
| 4,226,194 | A | 10/1980 | Grahn | |
| 4,480,177 | A | 10/1984 | Allen | |
| 4,610,806 | A | 9/1986 | Rosen | |
| 4,841,752 | A | 6/1989 | Fletcher | |
| 4,867,076 | A | 9/1989 | Marcone | |
| 5,311,166 | A | 5/1994 | Frye | |
| 5,318,147 | A | 6/1994 | Maiefski | |
| 5,424,712 | A * | 6/1995 | Rosenberger | B60R 25/10 340/425.5 |
| 5,537,938 | A | 7/1996 | Lopez, Jr. | |
| 5,552,766 | A | 9/1996 | Lee et al. | |
| 5,598,793 | A | 2/1997 | Lopez | |
| 5,655,461 | A | 8/1997 | Gilbert | |
| 5,677,668 | A | 10/1997 | Winner | |
| 5,692,446 | A | 12/1997 | Becker et al. | |
| 6,895,873 | B1 | 5/2005 | Searle | |
| 8,539,890 | B2 | 9/2013 | Tripp et al. | |
| 8,555,792 | B2 | 10/2013 | Berendes | |
| 8,783,194 | B2 | 7/2014 | Sleat et al. | |
| 9,228,388 | B2 * | 1/2016 | Bolden | G08B 15/02 |
| 9,336,670 | B2 * | 5/2016 | Jones, Jr. | G08B 13/19695 |
| 2003/0033965 | A1 | 2/2003 | Van Lint | |
| 2006/0086348 | A1 | 4/2006 | Song | |
| 2009/0098800 | A1 | 4/2009 | Duprey | |
| 2009/0256676 | A1 * | 10/2009 | Piccirillo | E05B 41/00 340/5.65 |
| 2012/0240829 | A1 | 9/2012 | Van Dessel | |
| 2013/0335193 | A1 * | 12/2013 | Hanson | H04W 12/06 340/5.61 |
| 2014/0158027 | A1 | 6/2014 | Bolden | |
| 2015/0120151 | A1 * | 4/2015 | Akay | B60R 25/24 701/49 |
| 2015/0292244 | A1 * | 10/2015 | Beatty | E05B 47/0012 70/20 |
| 2016/0035163 | A1 * | 2/2016 | Conrad | G07C 9/00309 340/5.61 |
| 2016/0042582 | A1 * | 2/2016 | Hyde | G07C 9/00944 70/53 |
| 2016/0047142 | A1 * | 2/2016 | Gengler | G07C 9/00571 340/5.61 |

OTHER PUBLICATIONS

European Extended Search Report issued in EP 13861841.9, dated Jun. 6, 2016.

* cited by examiner

SYSTEMS AND METHODS FOR MARKING INDIVIDUALS WITH AN INDENTIFYING SUSBSTANCE

CROSS REFERENCE TO RELATED APPLICATION:

The subject application is a Continuation Application of U.S. application Ser. No. 14/100,372, filed Dec. 9, 2013, which claims priority to United States Provisional Application Nos. 61/735,142 filed Dec. 10, 2012, the contents of which are incorporated herein by reference in their entirety.

FIELD OF THE DISCLOSURE

The present disclosure relates to systems and methods for marking an intruder with an identifying substance.

BACKGROUND OF THE DISCLOSURE

Bank robberies are an everyday occurrence, presenting both financial risk to the assets of a financial institution, as well as personal risk to its employees and customers. The FBI and major metropolitan police departments are constantly demanding that banks and other retail institutions do more to deter robberies. Banks are being pressured to install deterrents such as bullet resistance barriers on teller lines (bandit barriers), man traps (single entry/exit doors), metal detectors and other deterrents that are both costly and result in a negative customer experience. Recent developments in electronic and GPS tracking devices (to be given by the teller along with the robbery money) have also proven to be less than effective.

The conventional bank robbery deterrent has been dye packs. Dye packs contain a small detonation device that when activated, explodes, spreading dye on the stolen money as well as the perpetrator. Dye packs are costly to install and maintain. They also are subject to accidental detonation and may be unintentionally given to customers who suffer the effects of the detonation, creating a legal liability. For these and other reasons, several of the top 10 banks are removing dye pack systems from their branches as the return on investment does not support the installation and maintenance expense of these devices. Finally, studies by the American Bankers Association and peer banks indicate that dye packs are no longer a viable robbery deterrent. Their use is so well known that most robbers instruct tellers not to include them in the money they hand over. The removal of these systems is drawing criticism of local police departments. Also, the Bank Protection Act requires banks to employ systems and processes that will aid law enforcement in the identification of robbery suspects. Balancing compliance with law enforcement demands is becoming more and more difficult. There exists a need for a better, more cost effective robbery deterrent.

These and other drawbacks exist.

SUMMARY OF THE DISCLOSURE

The various embodiments disclosed herein relate to systems and methods for marking an individual with an identifying substance. The system includes a spray delivery device configured to release a pressurized substance in response to an activation signal, an activation device configured to transmit an activation signal to the spray delivery device, and a power supply, configured to provide power to at least one of the activation devices and the spray delivery devices. The method includes storing a pressurized substance, receiving an activation signal at a spray delivery device, and releasing the pressurized substance in response to the received activation signal.

The pressurized substance may be a spray, such as an ultraviolet light powder (UV powder), that leaves an invisible film. The example systems may include a control system that controls the spray delivery device and activation device. The example systems also may include a sensor communicatively coupled to the activation device. The sensor may be configured to detect the presence of the activator and cause the activation device to automatically transmit the activation signal based on the detected presence of the activator. The example systems also may include a switch communicatively coupled to the activation device.

The example systems also may detect the presence of an activator and cause an activation device to automatically transmit the activation signal based on the detected presence of the activator. The example systems also may determine whether a manual switch has been activated, and cause an activation device to transmit the activation signal based on a determination that the manual switch has been activated.

BRIEF DESCRIPTION OF THE DRAWINGS

Various embodiments of the present disclosure, together with further objects and advantages, may best be understood by reference to the following description taken in conjunction with the accompanying drawings, in the several Figures of which like reference numerals identify like elements, and in which.

DETAILED DESCRIPTION OF THE EMBODIMENTS

Figure 1:
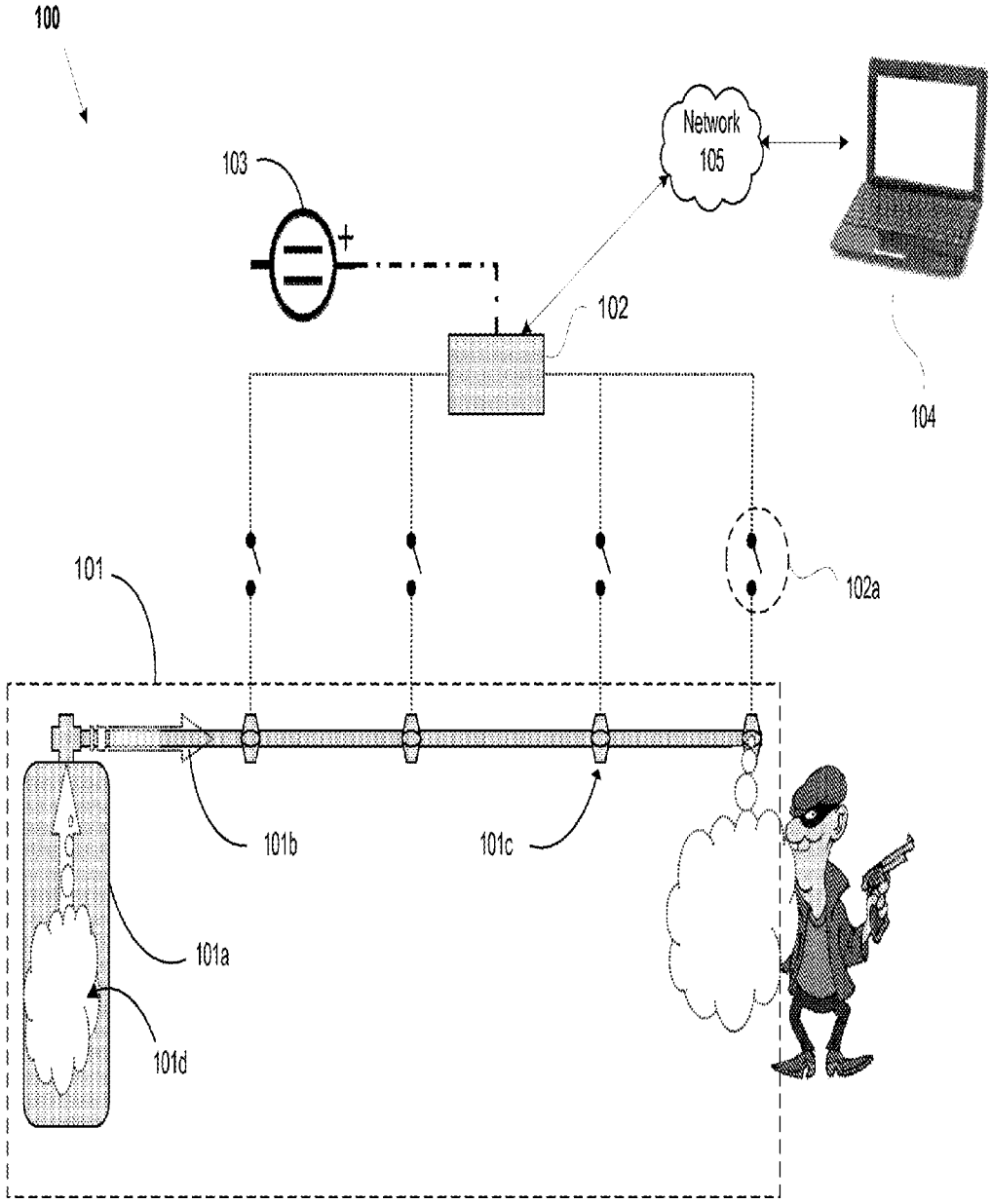
FIG. 1 depicts a schematic diagram of a system for releasing an identifying substance in response to an activation signal according to an example embodiment of the disclosure.

The following description is intended to convey a thorough understanding of the embodiments described by providing a number of specific exemplary embodiments and details involving systems and methods for spraying an identifying substance on intruders. It should be appreciated, however, that the present disclosure is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs. A financial institution and system supporting a financial institution are used as examples for the disclosure. The disclosure is not intended to be limited to financial institutions only. For example, the embodiments disclosed herein may be used to mark intruders in other retail institutions, including without limitation, department stores, jewelry stores, consumer electronics retailers and other like institutions or entities.

Various embodiments of the disclosure provide a safe alternative to dye packs (or an additional deterrent to dye packs). The various embodiments also may be used to mark intruders and/or thieves in other similar environments as described above. The various embodiments include systems and methods for surreptitiously marking the robber with an identifying substance so that they can be easily identified by responding police. One example of an identifying substance is ultraviolet light powder ("UV powder"). UV powder is currently available on the open market. If simply sprayed on any surface, it leaves an invisible film that, if contacted, will remain on the hands or clothing for days despite repeated washings. Although invisible and undetectable to the naked eye, the spray is highly fluorescent when exposed to UV illumination. Anyone touching a "marked" item will retain the powder on their hands, making them easy to identify.

The embodiments disclosed herein may use the UV powder as part of a spray delivery system that may be secreted underneath a teller counter at a bank, for example, releasing a brief spray of the powder to mark the clothing of a robber without their detection when the teller trips the robbery alarm. Upon leaving the branch, the clothing of the robbery suspect could be quickly viewed by police under UV light to identify suspects. Even if clothing is later changed, police may discover it during a residence search as part of their robbery investigation and definitively tie the suspect to the robbery, even if no money or other evidence is found. The system removes the risk of accidental dye pack detonation and could be easily activated via the existing branch hold up alarm system. Although the embodiments contemplate UV powder, other like invisible and undetectable substances that leave an invisible film, but can be detected later by police to identify suspects can be used. Similarly, the location of the secreted substance may vary depending upon the various examples as described herein. Moreover, the embodiments disclosed herein may serve as additional deterrents to dye packs and other theft deterrent/intruder identification systems.

FIG. 1 depicts an exemplary embodiment of a system 100 for marking an intruder using an identifying substance. System 100 may include various network-enabled computer systems, including, as depicted in FIG. 1 for example, control system 104, which may be included as separate processors or combined into a single processor or device having the multiple processors. As referred to herein, a network-enabled computer system and/or device may include, but is not limited to: e.g., any computer device, or communications device including, e.g., a server, a network appliance, a personal computer (PC), a workstation, a mobile device, a phone, a handheld PC, a personal digital assistant (PDA), a thin client, a fat client, an Internet browser, or other device. The network-enabled computer systems may execute one or more software applications to, for example, receive data as input from an entity accessing the network-enabled computer system, process received data, transmit data over a network, and receive data over a network. The one or more network-enabled computer systems may also include one or more software applications to activate one or more spray delivery devices, as described herein.

The components depicted in FIG. 1 may be coupled via one or more networks, such as, for example, network 105. Network 105 may be one or more of a wireless network, a wired network or any combination of wireless network and wired network. For example, network 105 may include one or more of a fiber optics network, a passive optical network, a cable network, an Internet network, a satellite network, a wireless LAN, a Global System for Mobile Communication ("GSM"), a Personal Communication Service ("PCS"), a Personal Area Network ("PAN"), D-AMPS, Wi-Fi, Fixed Wireless Data, IEEE 802.11b, 802.15.1, 802.11n and 802.11g or any other wired or wireless network for transmitting and receiving a data signal.

In addition, network 105 may include, without limitation, telephone lines, fiber optics, IEEE Ethernet 902.3, a wide area network ("WAN"), a local area network ("LAN"), or a global network such as the Internet. Also network 105 may support an Internet network, a wireless communication network, a cellular network, or the like, or any combination thereof. Network 105 may further include one network, or any number of the exemplary types of networks mentioned above, operating as a stand-alone network or in cooperation with each other. Network 105 may utilize one or more protocols of one or more network elements to which they are communicatively coupled. Network 105 may translate to or from other protocols to one or more protocols of network devices. Although network 105 is depicted as a single network, it should be appreciated that according to one or more embodiments, network 105 may comprise a plurality of interconnected networks, such as, for example, the Internet, a service provider's network, a cable television network, corporate networks, and home networks.

Spray delivery apparatus 101 may be configured to release a pressurized substance in response to a signal from activation device 102, activation switch 102*a*, and/or control system 104. Spray delivery apparatus 101 may comprise one or more components, including storage component 101*a*, one or more transport conduits 101*b*, one or more actuators 101*c*, and pressurized substance 101*d*.

Storage component 101*a* may be a pressurized canister configured to hold a pressurized substance 101*d*. While FIG. 1 depicts a single storage component, spray delivery apparatus 101 may comprise a plurality of storage components, depending on the size of the facility where the system is to be deployed. Storage component 101*a* may be a refrigerated container.

The pressurized substance 101*d* may be a substance that is undetectable to the naked eye, such as, for example, a UV powder that is only visible when exposed to ultraviolet light. The UV powder may be stored in one or more canisters as part of spray delivery apparatus 101.

Storage component 101*a* may be operably connected to one or more transport conduits 101*b*. Transport conduit 101*b* may be configured to connect storage component 101*a* to one or more actuators 101*c*. Transport conduit 101*b* may include one or more pipes and/or valves. The one or more valves may be selectively controllable using, for example, control system 104. For example, control system 104 may be configured to allow a user to selectively open one or more valves in transport conduit 101*b* in order to direct the flow of the stored substance to a desired actuator. The control system also may allow a user to close one or more valves in order to perform maintenance and repairs on one or more components of spray delivery apparatus 101.

Spray delivery apparatus 101 may further comprise one or more actuators 101*c*. Each of the one or more actuators 101*c* may include a pressure release valve and a nozzle (not shown). Actuator 101*c* may be configured to open a pressure release valve in response to an actuation signal received from actuation device 102, activation switch 102*a*, and/or control system 104. Opening a pressure release valve may release the pressurized substance 101*d* as a spray. The pressure release valve and nozzle of the actuator may be configured to release the pressurized substance in a specific direction. The pressure release valve and nozzle of an actuator may be configured to release the pressurized substance at a given pressure. For example, the pressure release valve and nozzle of an actuator may be configured release the pressurized substance at a pressure that makes the spray undetectable by a suspect. A user may select a given pressure using, for example, control system 104.

System 100 may include one or more activation devices 102. The activation device may be an alarm panel. Activation device 102 may be configured to send an activation signal to spray delivery apparatus 101. Activation device 102 may send the activation signal in response to an activation switch 102*a* being triggered. Activation switch 102*a* may be a button. Alternatively, or additionally, activation device may send the activation signal in response to a signal from control system 104.

Activation device 102 may be configured to activate an alarm in response to activation switch 102*a* being triggered. The alarm may be a silent alarm.

Activation switch 102*a* may be configured to be triggered by a user, such as by an employee of a financial institution. Activation switch 102*a* also may be automatically triggered in response to an event. For example, activation switch 102*a* may be configured to automatically trigger when one or more motion sensors detect motion. Activation switch 102*a* may be configured to automatically trigger when one or more cameras detect motion. Activation switch 102*a* may be configured to automatically trigger when one or more heat sensors detect a certain amount of heat. Activation switch 102*a* may be configured to automatically trigger when a door and/or window is opened. These and other configurations are contemplated.

Activation switch 102*a* may be configured to respond at pre-designated times. For example, a retail establishment may locate motion sensors at doors and/or windows around the facility. Activation switch 102*a* may be configured to only respond to detected motion during times when the retail establishment is closed.

System 100 may include one or more power sources 103. Power source 103 may be configured to supply power to activation device 102, spray delivery apparatus 101, control system 104, and/or network 105. Power source 103 may be a traditional power supply that converts AC line voltage to DC voltage. Power source 103 may be an electromechanical supply, such as a generator and/or alternator. Power source 103 may be an energy storage device such as a fuel cell or battery. Power source 103 may be any combination of the aforementioned components.

System 100 can be deployed in a variety of contexts. For example, system 100 could be deployed in a financial institution, such as a bank. The one or more actuators 101*c* could be discretely placed at one or more teller windows, so that in response to an activation signal, the actuators would release a pressurized substance 101*d* in the direction of the person standing on the customer-side of the teller window. One or more activation switches 102*a* could be placed behind each teller window, within reach of a teller or bank manager. The activation switches 102*a* may be physical buttons. Activation switches may be electronically represented as an graphical user interface (GUI) on a screen, allowing a user to trigger a switch by clicking one or more icons on a screen. Activation switches may be electronically represented as icons on a touch-screen of a mobile device, allowing a user to trigger a switch by touching the appropriate icon on a screen.

In the event that an intruder—such as a bank robber—approaches a teller window and demands money, a teller at the window could discretely trigger an activation switch 102*a*, which would send a signal to activation panel 102. This may trigger an alarm, such as a silent alarm. Activation panel 102 may then send an activation signal to one or more actuators 101*c* in the vicinity of the intruder. The actuators 101*c* may spray the pressurized substance on the intruder. A bank employee watching a video of the event could also remotely trigger activation switch 102*a* or activation device 102 using control panel 104.

In the aforementioned example, the one or more actuators 101*c* could additionally or alternatively be placed at the entrance to the bank, or at the door of the vault. The actuators could be activated by a bank employee when the intruder attempts to exit the bank, spraying the intruder with the pressurized substance as he or she leaves the bank. The suspect also may be given or be carrying an activator communicatively coupled to the activation switch that could, for example, automatically activate the actuators when the suspect attempts to leave the bank. For example, the bank teller could give the suspect a pack of money that includes a proximity activator that activates the actuators when the suspect passes through the bank exit. Similarly, in retail establishments, certain retail items may include activators that activate the actuators when a suspect carrying the retail item containing the activation switch that activates the actuators when the suspect leaves the store. In these embodiments, system 100 may be configured to detect the presence of an activator and automatically activate the actuators via, for example, the activation panel 102.

In another exemplary embodiment, marking system 100 could be deployed at a kiosk, such as an automatic teller machine (ATM). The activation switch 102*a* could be automatically activated in the event an individual attempts to tamper with the kiosk, such as by attempting to install an unauthorized card reading device (a "skimmer") at an ATM. The one or more actuators 101*c* could be discretely located on or around the ATM to spray a pressurized substance on the unauthorized intruder in response to a signal from the activation switch 102*a*.

Marking system 100 could be configured to operate in a retail store to spray a pressurized substance on an individual attempting to break in when the store is closed. The one or more activation switches 102*a* may be automatically activated in response to one or more motion sensors that detect movement around the doors and/or windows of the store. One or more actuators 101*c* could be strategically placed around the doors and/or windows of the retail store to spray a pressurized substance in response to the signal from the activation device and/or the activation switches. Actuators could be located at or around display cases for particularly valuable items.

Marking system 100 could be configured to operate in an automobile to spray a pressurized substance on a car thief. For example, activation switch 102*a* could be configured to automatically trigger in response to a car thief's attempt to hotwire the ignition of the car. The marking system 100 may include a sensor in the steering column of the automobile. If the sensor detects ignition tampering, it may automatically trigger the activation switch, causing one or more actuators that may be located on or around the steering column to release the pressurized substance. Activation switch 102*a* may be configured to automatically trigger in response to an attempt to pick the lock on the door of the car. One or more actuators 101*c* may be located at different places in and around the automobile, such as on the steering column, or around the door.

Figure 2:
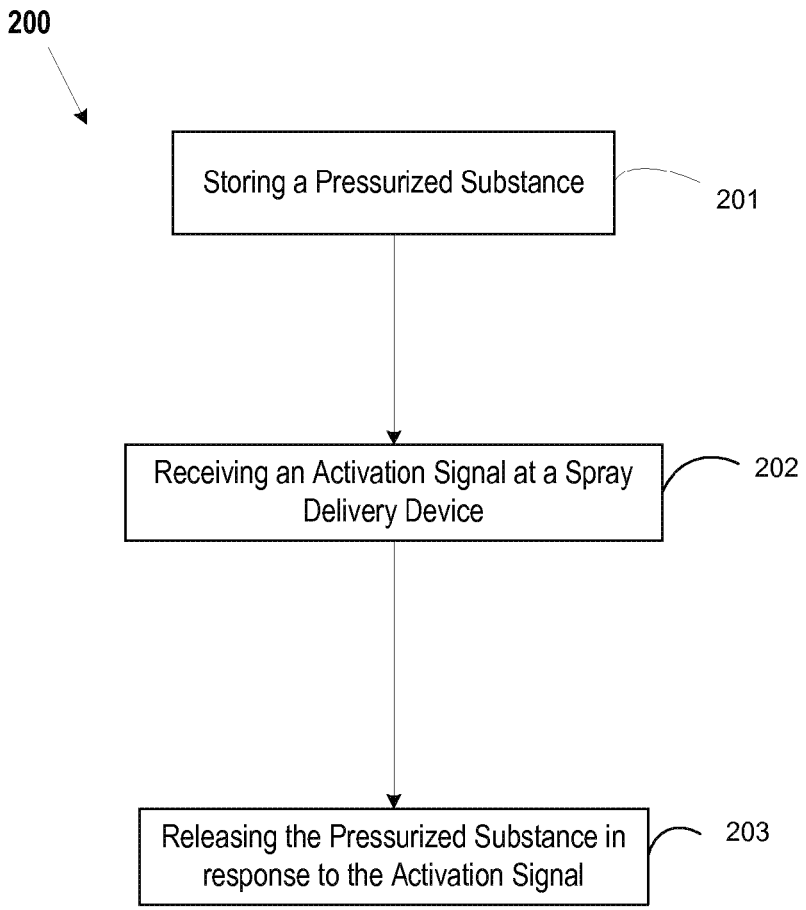
FIG. 2 is a flow chart illustrating a method for marking an intruder with an identifying substance according to an example embodiment of the disclosure.

FIG. 2 is a flow chart illustrating an example method 200 for spraying a pressurized substance in response to an activation signal. The method 200 shown in FIG. 2 can be executed or otherwise performed by one or more combinations of various systems. The method 200 as described below may be carried out by a system similar to the system for marking an intruder with an identifying substance as shown in FIG. 1, by way of example, and various elements of that system are referenced in explaining the method of FIG. 2. Each block shown in FIG. 2 represents one or more processes, methods, or subroutines in the example method 200. Referring to FIG. 2, the example method 200 may begin at block 201.

In block 201, method 200 may include storing a pressurized substance. The pressurized substance may be stored in, for example, a vessel or a canister. The pressurized substance may be designed to mark the clothing or skin of the individual it contacts. The pressurized substance may be undetectable to the naked eye. The pressurized substance may be a UV powder that is only visible when exposed to ultraviolet light. The pressurized substance may be stored at a temperature below room temperature. Method 200 may continue at block 202.

In block 202, method 200 may include receiving an activation signal at a spray delivery device. The spray delivery device may be a device similar to the spray delivery apparatus 101 depicted in FIG. 1 and described above. The activation signal may be sent by an activation device and/or activation switch similar to the activation device 102 and activation switch 102*a* depicted in FIG. 1 and described above. The activation signal may be sent by a control system, such as the control system 104 depicted in FIG. 1 and described above. The activation signal may be sent in response to a user command. The activation signal may be sent automatically in response to an event. Method 200 may continue at block 203.

In block 203, method 200 may include releasing the pressurized substance in response to the received activation signal. The pressurized substance may be sprayed using one or more actuators, such as the actuators 101*c* depicted in FIG. 1 and described above. The actuators may be configured to release the pressurized substance in a certain direction, at a variable pressure. Method 200 may then end.

Figure 3:
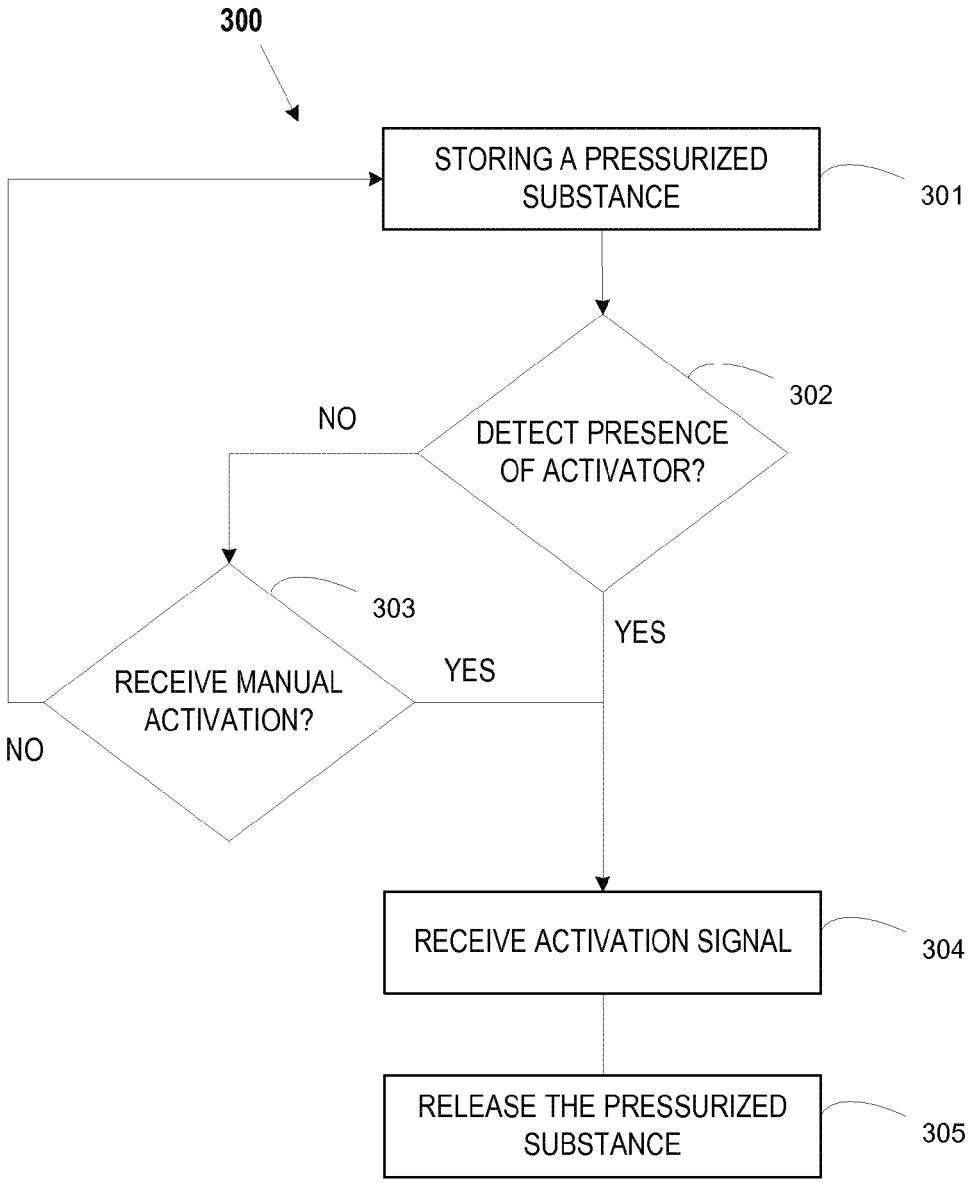
FIG. 3 is a flow chart illustrating a method for marking an intruder with an identifying substance according to an example embodiment of the disclosure.

FIG. 3 is a flow chart illustrating an example method 300 for spraying a pressurized substance in response to an activation signal. The method 300 shown in FIG. 3 can be executed or otherwise performed by one or more combinations of various systems. The method 300 as described below may be carried out by a system similar to the system for marking an intruder with an identifying substance as shown in FIG. 1, by way of example, and various elements of that system are referenced in explaining the method of FIG. 3. Each block shown in FIG. 3 represents one or more processes, methods, or subroutines in the example method 200. Referring to FIG. 3, the example method 300 may begin at block 301.

In block 301, method 300 may include storing a pressurized substance. The pressurized substance may be stored in, for example, a vessel or a canister. The pressurized substance may be designed to mark the clothing or skin of the individual it contacts. The pressurized substance may be undetectable to the naked eye. The pressurized substance may be a UV powder that is only visible when exposed to ultraviolet light. The pressurized substance may be stored at a temperature below room temperature. The location where the pressurized substance is stored may vary depending upon the environment where the method is implemented. For example, in a bank, the pressurized substance may be stored at or near the bank counter where a robbery suspect might approach the bank teller at a counter. The pressurized substance also may be stored near the bank exits and/or near or at the drive-thru. The pressurized substance also may be stored some distance from the actuators and the actuators may be placed at various locations throughout the bank. In retail establishments, the pressurized substance may be stored in similar locations, such as the exit, or other locations that could deter theft of merchandise. Method 300 may continue at block 302.

In block 302, the presence of an activator may be detected. In various examples, sensors placed in banks or retail establishments may sense that an activator is at or near the sensor. For example, the exits at banks or retail establishments may be equipped with sensors that can detect the presence of an activator. In various examples, the suspect intentionally or unintentionally may be carrying the activator. For example, the suspect may be carrying a retail item the suspect is attempting to steal that includes an activator. The suspect also may be carrying an activator (e.g. in a pack of money or receipt) that was surreptitiously given to the suspect by a bank teller or retailer. If an activator is detected in block 302, method 300 may proceed to block 304. If an activator is not detected, method 300 may proceed to block 303.

In block 303, it may be determined whether a manual activation signal has been received. For example, in block 303, it may be determined whether a bank teller or retailer has manually activated an actuator to release the pressurized substance. If a manual activation signal is received in block 303, method 300 may proceed to block 304. If a manual signal is not received, method 300 may proceed to block 302 and await activation.

In block 304, method 300 may include receiving an activation signal at a spray delivery device. The spray delivery device may be a device similar to the spray delivery apparatus 101 depicted in FIG. 1 and described above. The activation signal may be sent by an activation device and/or activation switch similar to the activation device 102 and activation switch 102*a* depicted in FIG. 1 and described above. The activation signal may be sent by a control system, such as the control system 104 depicted in FIG. 1 and described above. The activation signal may be sent in response to a user command. The activation signal may be sent automatically in response to an event, such as, for example the detection of the presence of an activator. In such an example, a control system may automatically transmit an activation signal to the activation panel, for example. Method 200 may continue at block 305.

In block 305, method 300 may include releasing the pressurized substance in response to the received activation signal. The pressurized substance may be sprayed using one or more actuators, such as the actuators 101*c* depicted in FIG. 1 and described above. The actuators may be configured to release the pressurized substance in a certain direction, at a variable pressure. Method 300 may then end.

It is further noted that the software described herein maybe tangibly embodied in one of more physical media, such as, but not limited to, a compact disc (CD), a digital versatile disc (DVD), a floppy disk, a hard drive, read only memory (ROM), random access memory (RAM), as well as other physical media capable of storing software, or combinations thereof. Moreover, the figures illustrate various components (e.g., servers, computers, processors, etc.) separately. The functions described as being performed at various components may be performed at other components, and the various components bay be combined or separated. Other modifications also may be made.

In the preceding specification, various preferred embodiments have been described with references to the accompanying drawings. It will, however, be evident that various modifications and changes may be made thereto, and additional embodiments may be implemented, without departing from the broader scope of the invention as set forth in the claims that follow. The specification and drawings are accordingly to be regarded as an illustrative rather than restrictive sense.

The invention claimed is:

1. A system for marking an individual with an identifying substance, comprising:

a spray delivery device communicatively coupled to an activation device via a network and configured to release a pressurized substance in response to an activation signal, wherein the spray delivery device comprises a storage component, one or more transport conduits, and one or more actuators, wherein the pressurized substance is an ultra violet light powder that leaves an invisible film on a marked individual, and wherein the storage component is operably connected to the one or more transport conduits, and the one or more transport conduits are configured to connect the storage component to the one or more actuators;

an activation switch communicatively coupled to the activation device via a network, wherein the activation switch comprises a graphical user interface and is configured to trigger the activation device in response to a user command or an event; and a power supply, configured to provide power to at least one of the activation device and the spray delivery device;

wherein the activation device is configured to automatically transmit the activation signal to the spray delivery device in response to the activation switch being triggered by the user command or event, via a control system.

2. The system of claim 1, wherein the actuator comprises a pressure release valve and a nozzle, wherein the actuator is configured to open the pressure release valve in response to the actuation signal received from the actuation device, activation switch and/or control system to release the pressurized substance in a specified direction, at a variable pressure.

3. The system of claim 1, wherein the storage component is a canister or vessel configured to hold the pressurized substance.

4. The system of claim 1, wherein the storage component is a refrigerated container.

5. The system of claim 1, wherein the one or more transport conduits are pipes and/or valves that are selectively controllable using the control system.

6. The system of claim 1, wherein the activation device is an alarm panel.

7. The system of claim 1, wherein the activation switch further comprises a button.

8. The system of claim 1, wherein the graphical user interface is configured to receive the user command via a user touching an appropriate icon on a screen, and/or icons on a touchscreen.

9. The system of claim 1, wherein the event comprises a detection of motion by one or more sensors.

10. The system of claim 1, wherein the event comprises a detection of a predetermined amount of heat by one or more heat sensors.

11. A method for marking an individual with an identifying substance, comprising:

storing a pressurized substance in a spray delivery device communicatively coupled to an activation device via a network, wherein the pressurized substance is an ultra violet light powder that leaves an invisible film on a marked individual;

receiving, at the activation device, trigger data from an activation switch communicatively coupled to the activation device, wherein the activation switch comprises a graphical user interface and the trigger data is based on a user command or event received via the activation switch;

automatically transmitting an activation signal from an activation device to the spray delivery device in response to the trigger data, via a control system; and releasing the pressurized substance in response to the received activation signal.

12. The method of claim 11, further comprising:

maintaining an activation device within a retail establishment, the activation device coupled to the stored pressurized substance in a manner that enables the spray delivery device to release the pressurized substance in response to the received activation signal.

13. The method of claim 11, further comprising:

maintaining an activation device within a financial institution, the activation device coupled to the stored pressurized substance in a manner that enables the spray delivery device to release the pressurized substance in response to the received activation signal.

14. The method of claim 11, further comprising:

maintaining an activation device within a kiosk, the activation device coupled to the stored pressurized substance in a manner that enables the spray delivery device to release the pressurized substance in response to the received activation signal.

15. The method of claim 11, further comprising:

maintaining an activation device within an automobile, the activation device coupled to the stored pressurized substance in a manner that enables the spray delivery device to release the pressurized substance in response to the received activation signal.

16. The method of claim 11, wherein the activation device is an alarm panel.

17. The method of claim 11, wherein the activation switch further comprises a button.

18. The method of claim 11, wherein the graphical user interface is configured to receive the user command via a user touching an appropriate icon on a screen, and/or icons on a touchscreen.

19. The method of claim 11, wherein the detected event comprises a detection of motion by one or more sensors.

20. The method of claim 11, wherein the detected even comprises a detection of a predetermined amount of heat by one or more sensors.

* * * * *